United States Patent [19]

Beschoner et al.

[11] 4,094,675

[45] June 13, 1978

[54] VAPOR DEPOSITION OF PHOTOCONDUCTIVE SELENIUM ONTO A METALLIC SUBSTRATE HAVING A MOLTEN METAL COATING AS BONDING LAYER

[75] Inventors: Hans-Hermann Beschoner, Bad Westernkotten; Gottfried Guder, Belecke; Hartmut Dulken, Belecke; Karl-Heinz Kassel, Belecke, all of Germany

[73] Assignee: LICENTIA Patent-Verwaltungs-G.m.b.H., Frankfurt am Main, Germany

[21] Appl. No.: 489,440

[22] Filed: Jul. 17, 1974

[30] Foreign Application Priority Data

| | | |
|---|---|---|
| Jul. 23, 1973 | Germany | 2337386 |
| Jul. 23, 1973 | Germany | 7326993 |

[51] Int. Cl.[2] ..... G03G 5/04; C25D 5/00; C23C 13/02

[52] U.S. Cl. ..... 96/1.5; 427/76; 427/248 H; 427/250; 427/404; 427/405

[58] Field of Search ..... 96/1.5; 117/106 R, 107, 117/217, 215; 427/404 R, 383 C, 383 D, 76, 405, 248, 250

[56] References Cited

U.S. PATENT DOCUMENTS

| | | | |
|---|---|---|---|
| 1,418,362 | 6/1922 | Coblentz | 252/501 X |
| 2,613,301 | 10/1952 | Dubar et al. | 96/1.5 |
| 2,629,039 | 2/1953 | Shoemaker | 427/383 C |
| 2,803,542 | 8/1957 | Ullrich | 96/1.5 |
| 2,822,300 | 2/1958 | Mayer et al. | 96/1.5 X |
| 2,886,434 | 5/1959 | Owens | 96/1.5 |
| 3,234,020 | 2/1966 | Stockdale | 96/1.5 |
| 3,243,293 | 2/1966 | Stockdale | 96/1.5 |
| 3,393,070 | 7/1968 | Snelling | 96/1.5 |
| 3,447,234 | 6/1969 | Reynolds et al. | 96/1.5 X |
| 3,522,087 | 7/1970 | Lacal | 117/215 X |
| 3,733,182 | 5/1973 | Crossland et al. | 117/217 X |
| 3,758,301 | 9/1973 | Gunther | 96/1.5 |
| 3,761,309 | 9/1973 | Schmitter et al. | 117/217 X |
| 3,772,077 | 11/1973 | Magee | 117/217 X |
| 3,799,775 | 3/1974 | Petruzzella | 96/1.5 |
| 3,930,853 | 1/1976 | Ciuffini | 96/1.5 |
| 4,011,079 | 3/1977 | Berle et al. | 96/1.5 |

FOREIGN PATENT DOCUMENTS

| | | | |
|---|---|---|---|
| 1,909,913 | 10/1969 | Germany | 96/1.5 |
| 38-17247 | 9/1963 | Japan | 96/1.5 |
| 38-14895 | 8/1963 | Japan | 96/1.5 |
| 38-20697 | 10/1963 | Japan | 96/1.5 |

OTHER PUBLICATIONS

Keck, "Photoconductivity in Vacuum Coated Selenium Films," *Journal of the Optical Society of America*, vol. 42, No. 4, Apr. 1952, pp. 221–225.

*Primary Examiner*—John T. Goolkasian
*Attorney, Agent, or Firm*—Spencer & Kaye

[57] ABSTRACT

An electrophotographic image carrier is made by depositing an intermediate layer on an electrically conductive substrate and then vapor-depositing, on the intermediate layer, an inorganic photoconductive layer while maintaining the temperature of the substrate during the deposition of the photoconductive layer at a value which is above the melting point of the intermediate layer, but below the damaging temperature of the photoconductive layer.

9 Claims, 1 Drawing Figure

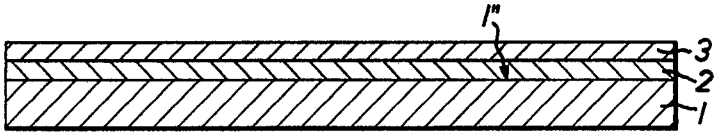
1"
3
2
1

VAPOR DEPOSITION OF PHOTOCONDUCTIVE SELENIUM ONTO A METALLIC SUBSTRATE HAVING A MOLTEN METAL COATING AS BONDING LAYER

BACKGROUND OF THE INVENTION

This invention relates to an electrophotographic image carrier of the type which has a vapor-deposited, inorganic photoconductive layer that is bonded to an electrically conductive metal or metallized substrate by means of an intermediate layer.

At the present time, of the known inorganic photoconductors, the most suitable base material for the commercial manufacture of electrophotographic image carriers has been found to be the amorphous, vitreous selenium because of its good charge-storing and sufficient electric conducting capabilities. When amorphous selenium, or selenium doped with halogen, or selenium-containing compounds and mixtures, such as mixtures with arsenic are used as a photoconductive layer that is vapor-deposited on a substrate or a base, the problem of improving the bond of this layer - which by itself has insufficient adhesive properties - with the substrate is continuously encountered.

The different thermal expansions of the base and of the photoconductive layer may result in breaking away or flaking of the layer from its base. It is further noted that the electrophotographic image carrier is, during commercial use, occasionally jarred or, developing balls contact its surface in such a manner that tears or flakings may result.

In the commercial use of selenium as a photoconductive layer, the selenium is generally applied to a rigid base which has the shape of a cylindrical drum. For the purpose of increasing the operational speed of an electrophotographic copying apparatus, it is known to use a flexible band as the image carrier. Such an arrangement is described, for example, in U.S. Pat. No. 3,146,688. In this manner, a substantial increase of the image surface and thus an increase in the operational speed is possible.

If the photoconductive layer is provided as a coating on a flexible band which is trained about rollers, the problems of adhesion of the layer to its substrate are even more pronounced since the continuous flexing of the photoconductive layer leads frequently to ruptures and flakings, particularly when the band is driven with high speeds.

There are known processes for manufacturing electrophotographic image carriers and for improving the adhesion of a photoconductive selenium layer on a substrate with diverse combinations which have the common characteristic that the photoconductive selenium layer is bonded to the substrate by means of an intermediate layer.

A method for the manufacture of an electrophotographic image carrier plate of the above-outlined type is disclosed, for example, in German Laid-Open Application (Offenlegungsschrift) No. 1,926,056. According to the process described therein, for improving the adhesion, an essentially organic intermediate layer made of a substituted silylisobutyl ethylene diamine is applied to a clean, electrically conductive base. The intermediate layer, if it is applied in a wet coating process or as a liquid solution, has to be dried and subsequently, a selenium-containing photoconductive layer is applied to the intermediate layer.

Further, British Patent No. 1,243,384 discloses a xerographic system including an electrophotographic image carrier of the above-outlined type in which, for improving the adhesion of the photoconductive layer on an electrically conductive and also an insulating base, the photoconductive layer is bonded with the substrate by means of an intermediate layer made of graphite and, according to requirements, of the residue of a carrier liquid for the graphite. Although in this manner an advantageous adhesion can be accomplished, the dried intermediate graphite layer has a substantial surface roughness so that the usually 50 to 100-micron thick photoconductive layer applied thereto will have a surface roughness of such an extent that the image carrying surface of the photoconductive layer does not have the desired image resolution and further, this surface is difficult to clean.

SUMMARY OF THE INVENTION

It is an object of the invention to provide an electrophotographic image carrier of the above-described type with an intermediate layer, wherein the latter ensures a good adhesion and bond of the photoconductive layer on and with a metal or metallized substrate and in which the intermediate layer and the photoconductive layer vapor-deposited thereon can be of approximately uniform thickness and smooth external surface.

This object and others to become apparent as the specification progresses, are accomplished by the invention, according to which, briefly stated, the photoconductive layer is vapor-deposited on the intermediate layer, while for the duration of the vapor-deposition but at least at the beginning the metal or metallized substrate is maintained at a temperature that is higher than the melting point of the material of which the intermediate layer is made, but is lower than the temperature at which the material structure of the photoconductive layer would change in an undesired (damaging) manner.

Further, according to the invention, the materials for the intermediate layer are so selected that their melting point is below a maximum temperature to which the layer arrangement of the image carrier is exposed in the course of a treating step that succeeds the vapor-deposition of the photoconductive layer.

In this case the vapor-deposition of the photoconductive layer may be done on the substrate with the intermediate layer at a suitable temperature below the melting point of the material of the intermediate layer and the complete image carrier is exposed during a treating step subsequent to the application of the photoconductive layer to a temperature above the melting point of the material of the intermediate layer and below the damaging temperature of the material of the photoconductive layer.

BRIEF DESCRIPTION OF THE DRAWING

The sole FIGURE is a schematic sectional view of a preferred embodiment of the invention.

DESCRIPTION OF THE PREFERRED EMBODIMENTS

According to a preferred embodiment of the invention, the photoconductive layer is formed of amorphous selenium, or selenium doped with halogen, or a selenium alloy or a selenium compound. The photoconductive layer is vapor-deposited at the temperature of a metal substrate which is below the crystallizing temperature of the photoconductive layer.

An intermediate layer may be applied to the substrate by vapor-deposition or by spraying or by galvanization at a temperature usually adapted to such processes. The intermediate layer may be formed of one element of the group consisting of indium, gallium, bismuth, lead, tin or cadmium or an alloy of these elements. Or, the intermediate layer may be made of, or may contain, sulphur. According to the invention, the above-noted temperature of the substrate during the vapor-deposition of the photoconductive layer on the intermediate layer is above the melting point of the intermediate layer.

In an image carrier manufactured according to the invention, the uniform application and uniform thickness of the intermediate layer, as well as the photoconductive layer and its advantageous adhesion, is — particularly when the intermediate layer is made of one of the previously listed materials or an alloy of some of these materials — based on a flow phenomenon of the material, similar to the phenomenon taking place during a soldering process. In this respect, the advantageous materials for the intermediate layer are, for example, gallium, indium, gallium-indium alloys, Wood's metal (5 parts bismuth, 2.5 parts lead, 1.25 parts tin and 1.25 parts cadmium), Rose's alloy (2 parts bismuth, 1 part tin and 1 part lead) or different soldering tins.

The adhesion strength of the photoconductive layer in an image carrier constructed according to the invention is very satisfactory even if the substrate and the photoconductive layer have substantially different coefficients of expansion or have internal stresses. Thus, it is feasible to provide an image carrier according to the invention which has a rigid substrate such as a plate or a cylindrical drum or a flexible substrate such as a band or a thin sheet.

These advantages can be accomplished even in those layer arrangements provided according to the invention in which a vapor-deposited, non-metallic layer is connected with the substrate by means of an intermediate layer. Such layer arrangements are not necessarily electrophotographic image carriers.

EXAMPLE 1

The substrate is an aluminum drum. The surface of the drum which is to be provided with a coating according to the invention is first turned on a lathe with hard metal tools, then it is ground by means of a diamond and is subsequently polished by chemical means. The surface cleaned in this manner is subsequently placed in a vapor-depositing apparatus and exposed to a metal vapor mixture of gallium and indium while the temperature of the drum is maintained at room temperature. This vapor-deposition process is stopped after an intermediate layer of gallium-indium alloy of 0.1 - 1 micron thickness has been formed on the drum. It is noted that the melting point of this alloy is approximately 50° C. The drum is thereafter positioned in a selenium vapor-depositing apparatus and is heated to approximately 60° C and is maintained at this temperature while selenium is vapor-deposited on the intermediate layer provided previously on the drum surface. In this manner a photoconductive layer of amorphous selenium having a thickness of, for example, approximately 60 microns is formed.

EXAMPLE 2

The substrate is a steel plate 1. The plate surface 1'' which is to be provided with layers is chemically cleaned in a conventional manner. Subsequently, the cleaned plate surface 1'' is exposed in a vapor-depositing apparatus to indium vapor while the plate is maintained at room temperature. After the formation of an intermediate indium layer 2 for example, 0.6 micron thick, the vapor-depositing process is terminated. The melting point of the indium layer 2 is 150° C. Thereafter, the plate is positioned in another vapor-depositing apparatus and is heated to approximately 200° C and is maintained at this temperature while an $As_2Se_3$ layer 3, for example, 50 microns thick, is deposited on the intermediate layer 2.

It is to be understood that if sufficiently dimensioned vapor-depositing apparatuses are available, several drums or plates may be simultaneously provided with layers. It was found that the electrophotographic image carrier according to the invention has a mirror smooth upper surface of the photoconductive layer and further that the photoconductive layer has a high adhesive strength.

It will be understood that the above description of the present invention is susceptible to various modifications, changes and adaptations, and the same are intended to be comprehended within the meaning and range of equivalents of the appended claims.

We claim:

1. A method of making an electrophotographic image carrier, comprising the following steps:

(a) applying an intermediate layer on a electrically conductive substrate; the material of said intermediate layer being selected from the group consisting of indium, gallium, bismuth, lead, tin, cadmium, the alloys thereof and sulphur; said alloys consisting essentially of the elements constituting members of said group;

(b) subsequent to step (a), vapor-depositing an amorphous inorganic photoconductive layer made of selenium, a selenium alloy or a selenium compound, on said intermediate layer; and (c) at least at the beginning of step (b), maintaining the temperature of the substrate at a value which is above the melting point of the material of the intermediate layer and below the damaging temperature of the material of the photoconductive layer.

2. A method as defined in claim 1, wherein the substrate is a metal.

3. A method as defined in claim 1, wherein said substrate is metallized.

4. A method as defined in claim 1, wherein the intermediate layer is vapor-deposited on said substrate.

5. A method as defined in claim 1, wherein the intermediate layer is sprayed on said substrate.

6. A method as defined in claim 1, wherein the intermediate layer is applied to the substrate by galvanization.

7. A method as defined in claim 1, wherein the material of the intermediate layer contains sulphur.

8. A method as defined in claim 1, wherein step (a) comprises the vapor-deposition of a gallium-indium vapor mixture on an aluminum substrate while maintaining the subtrate at room temperature; step (b) comprises the vapor-deposition of selenium on the intermediate layer; and step (c) comprises the maintenance of the temperature of the substrate at about 60° C.

9. A method as defined in claim 1, wherein step (a) comprises the vapor-desposition of indium on a steel substrate, while maintaining the substrate at room temperature; step (b) comprises the vapor-deposition of $As_2Se_3$ on the intermediate layer; and step (c) comprises the maintenance of the temperature of the substrate at about 200° C.

* * * * *